United States Patent [19]

Chen

[11] Patent Number: 4,932,425

[45] Date of Patent: Jun. 12, 1990

[54] COMB OR BRUSH

[76] Inventor: Horng-Yuan Chen, No. 1, Alley 6 Lane 331 Min Sheng E. Rd. Taipei, Taiwan, Taiwan

[21] Appl. No.: 230,900

[22] Filed: Aug. 11, 1988

[51] Int. Cl.[5] ..... A45D 24/42

[52] U.S. Cl. ..... 132/119; 132/120

[58] Field of Search ..... 132/105, 107, 119, 120, 132/124, 126, 148, 152, 153, 154, 161; 119/88; 15/169, 184

[56] References Cited

U.S. PATENT DOCUMENTS

| | | | |
|---|---|---|---|
| 2,123,043 | 7/1938 | Hertzberg | 132/126 |
| 2,194,484 | 3/1940 | Segal | 132/120 |
| 2,238,603 | 4/1941 | Runnels | 132/120 |
| 2,515,094 | 7/1950 | Price | 132/153 |

*Primary Examiner*—John J. Wilson
*Assistant Examiner*—Adriene J. Lepiane
*Attorney, Agent, or Firm*—Sheldon & Mak

[57] ABSTRACT

A comb or brush includes a combing body having a combing portion implanting thereon a plurality of combing units and densely covered by a layer of bristles which collects thereon combings or brushings and forms a smooth contact surface for preventing one's hair from being broken as it is combed a result of being caught between the body and the roots of the combing units.

17 Claims, 9 Drawing Sheets

COMB OR BRUSH

BACKGROUND OF THE INVENTION

The present invention relates to a comb, and also to a brush.

Generally a comb or a brush (hereinafter intentionally omitted for a brief purpose but not intended to be excluded) includes a combing body having a combing portion implanting thereon combing units being single pieces or bundles of hairs and suffers from the following disadvantages:

(1) Combings or scraps remaining on the combing portion connot easily be cleaned.

(2) Combing units made of nylon bristles have their root portions mechanically curved and implanted on holes of the combing portion but still slightly protrude the root portions out of the holes and leave a possible clearance between the root portion and the hole. The root portion will thus retain and break the hair of the user and tangle therewith the broken hair which in turn makes a smooth combing impossible.

It is therefore tried by the applicant to deal with these problems encountered by the prior art.

SUMMARY OF THE INVENTION

It is therefore an object of the present invention to provide a comb capable of providing a smooth combing function and of preventing the hair from being broken.

It is further an object of the present invention to provide a comb capable of being easily cleaned.

According to the present invention, a comb includes a combing body having a combing portion, combing units having root portions thereof implanted on the combing portion, a frame secured to the combing portion, and a relatively large number of bristles provided along the frame for densely covering on the combing portion.

The present invention may best be understood through the following description with reference to the accompanying drawings, in which:

DETAILED DECRIPTION OF THE PREFERRED EMBODIMENT

Figure 1:
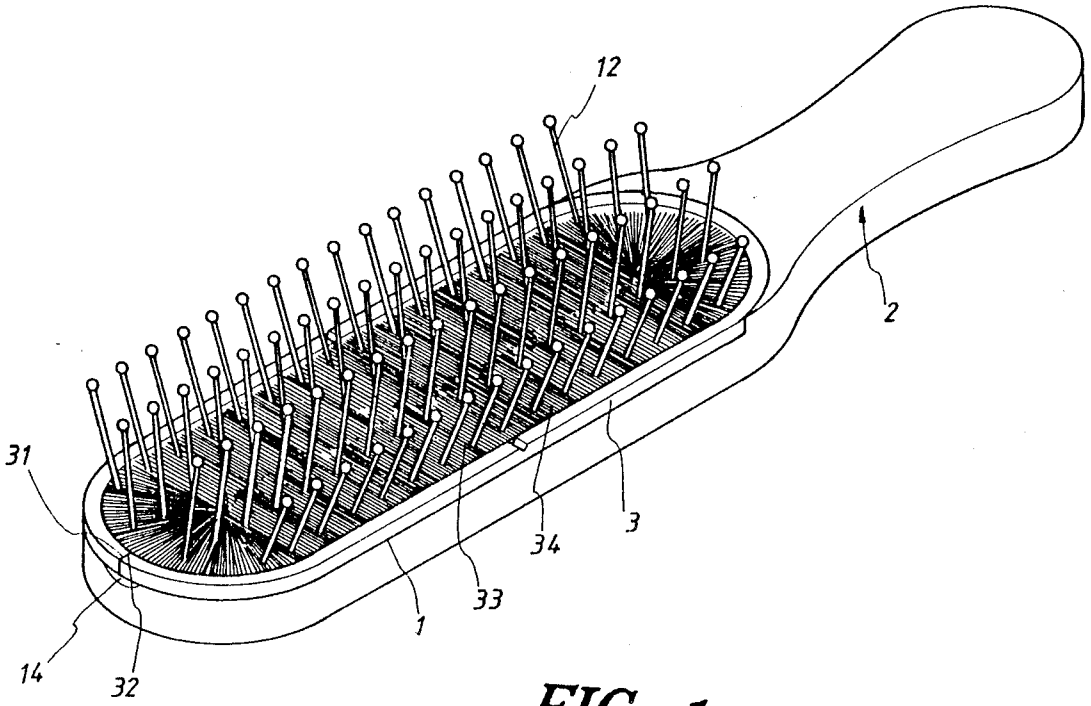
FIG. 1 is a perspective view showing a first preferred embodiment of a comb according to the present invention.
Figure 2:
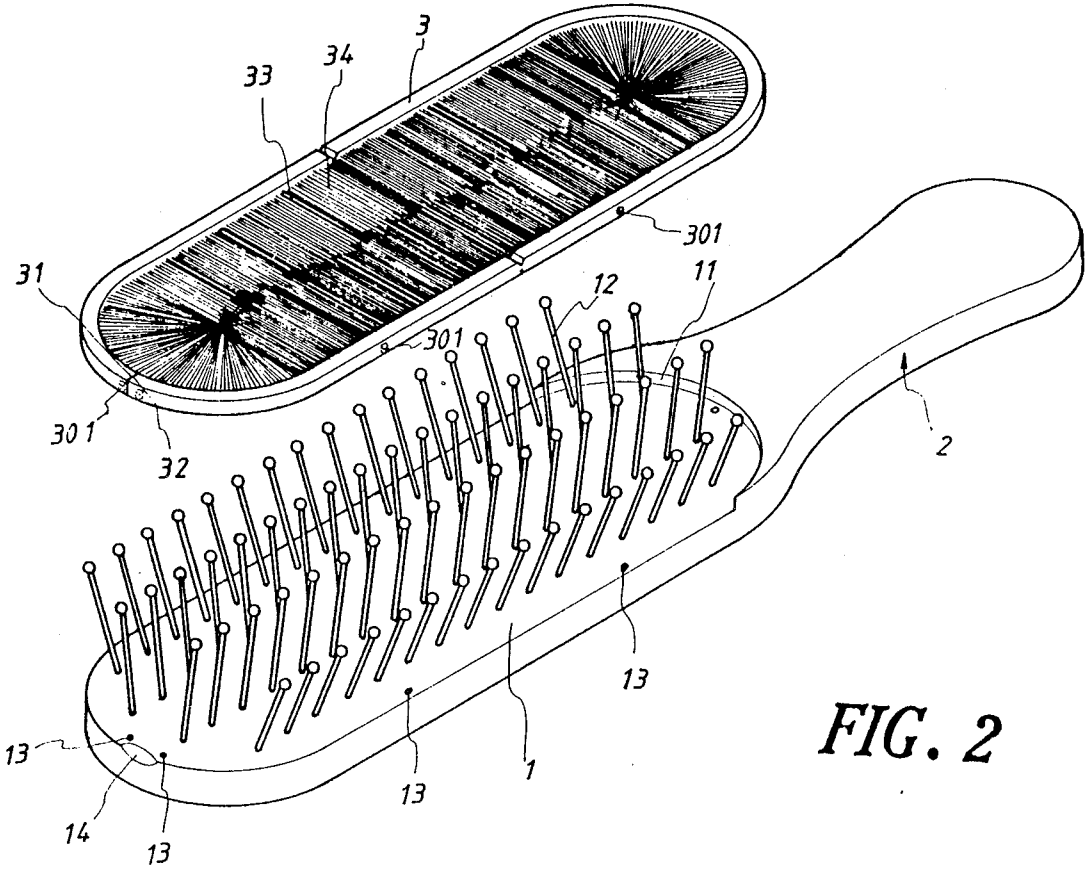
FIG. 2 is an exploded view of a comb in FIG. 1.
Figure 3:
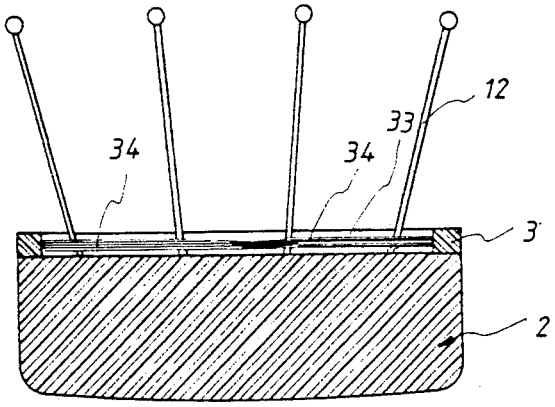
FIG. 3 is a transverse sectional view of a comb in FIG. 1.

Referring now to FIGS. 1 to 3, a first preferred embodiment of the present comb includes a combing body 2 having a combing portion 1 being lowered to define a shoulder surface 11, a plurality of combing units 12 having root portions thereof spacedly implanted on the combing portion 1, a flexible frame 3 which is curved around the circumference of combing portion 1 to meet two ends thereof 31, 32 together to constitute a closed loop and includes bottom protuberances 301 respectively detachably received in top recesses 13 provided on combing portion 1, and a great number of soft bristles 33 and soft bristles 34 (having a diameter different from that of bristles 33) being provided along one side of frame 3 for being capable of densely covering the combing portion 1 to form thereon a layer of bristles. A front indentation 14 of combing body 2 can allow frame 3 to be easily removed from combing portion 1.

Figure 4:
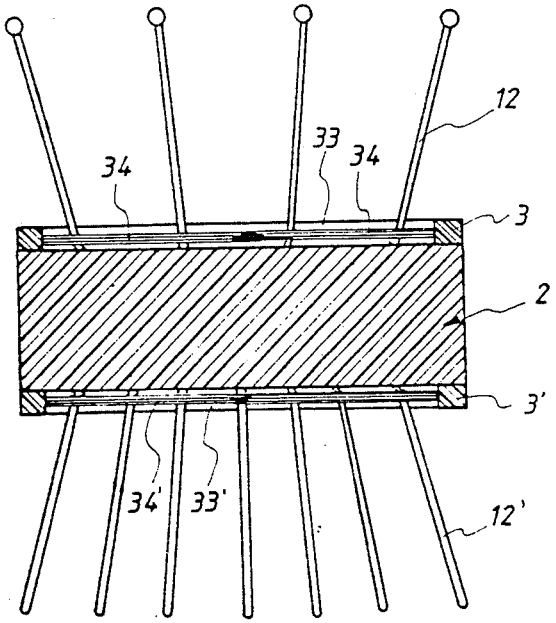
FIG. 4 is a transverse sectional view of a second preferred embodiment of a comb according to the present invention.

FIG.4 shows a comb substantially the same as the one shown in FIGS. 1 to 3 except that it has two opposite combing portions 1.

Figure 5:
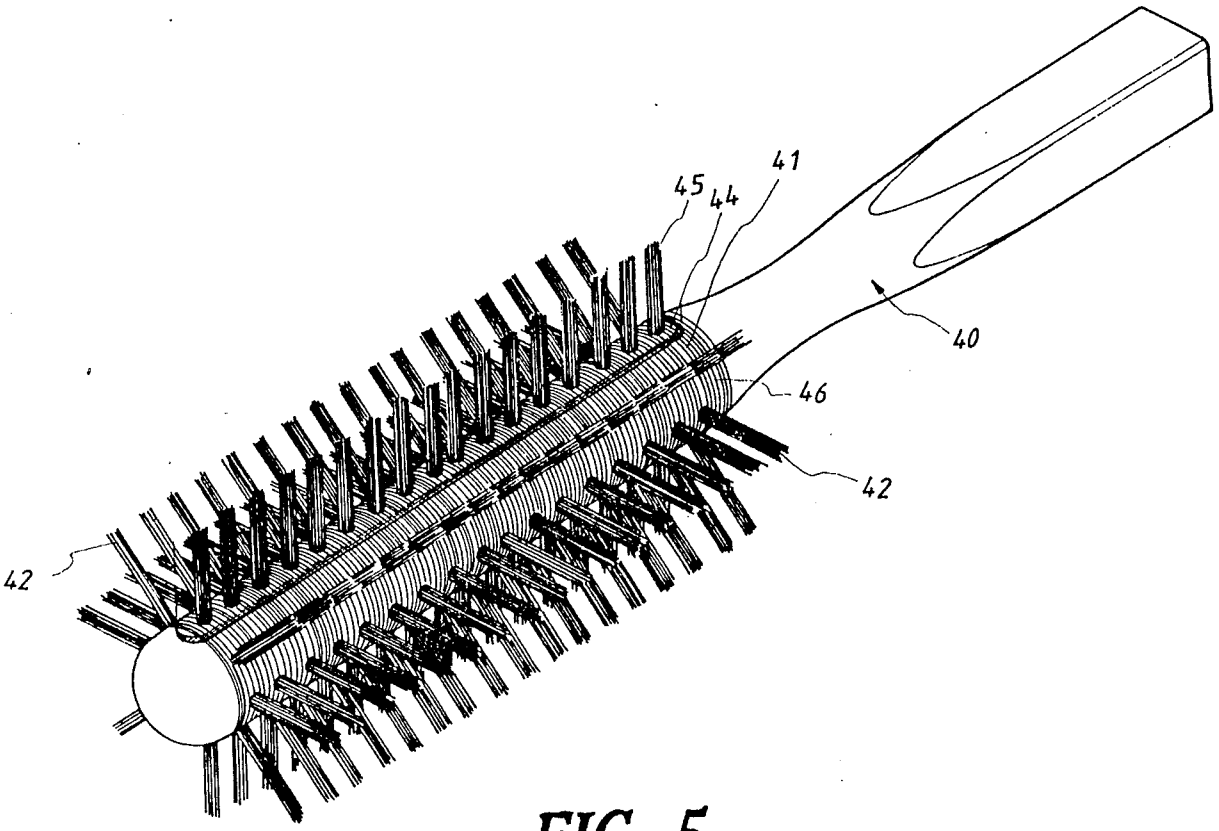
FIG. 5 is a perspective view showing a third preferred embodiment of a comb according to the present invention.
Figure 6:
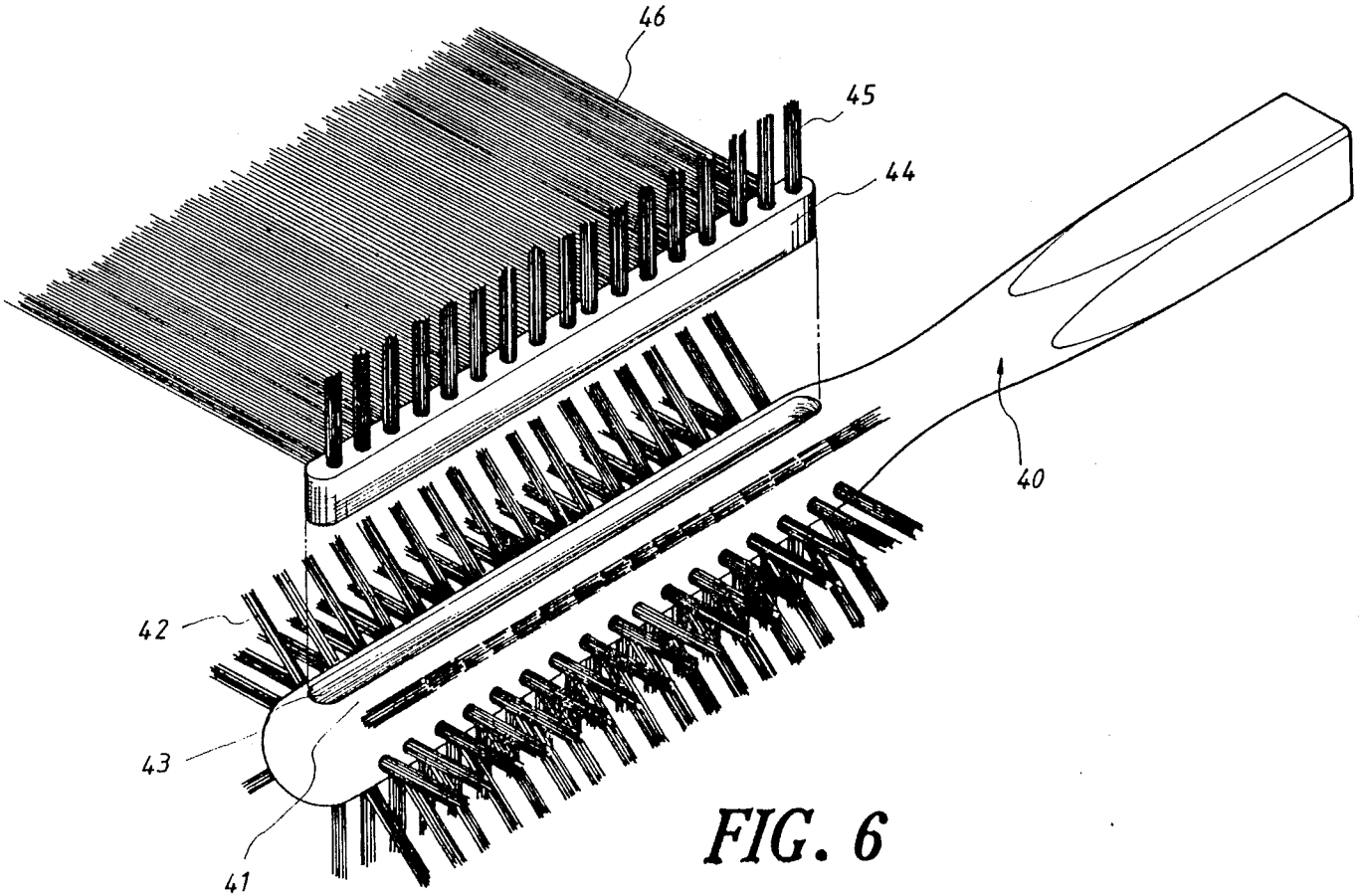
FIG. 6 is an exploded view of a comb in FIG.5.

As shown in FIGS. 5 and 6, a third preferred embodiment according to the present invention includes a combing body 40 having a cylindrical combing portion 41 which implants thereon combing units 42 and has a longitudinal groove 43 receiving therein a straight frame 44 which implants thereon combing units 45 shorter than combing units 42 and extends from one side thereof soft bristles 46 wound around combing portion 41 for densely covering thereon a layer of bristles. After frame 44 is detached from groove 43, combing units 45 which are originally designed to comb the upper ones of one's hair can be used now to clean combing units 42 and combing portion 41, if necessary.

Figure 7:
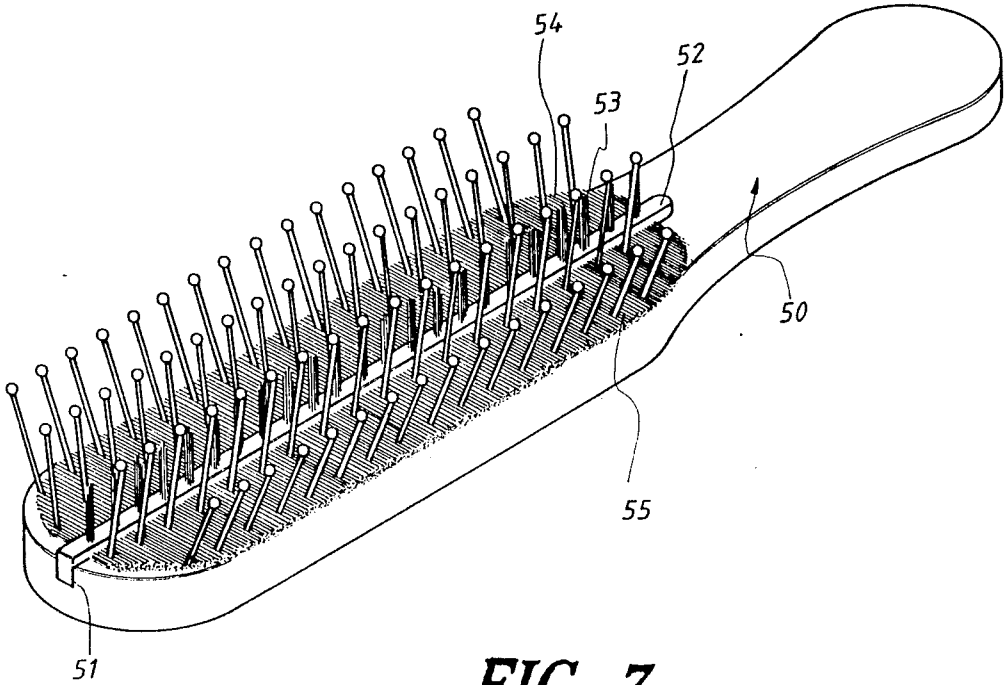
FIG.7 is a perspective view showing a fourth preferred embodiment; of a comb according to the present invention.
Figure 8:
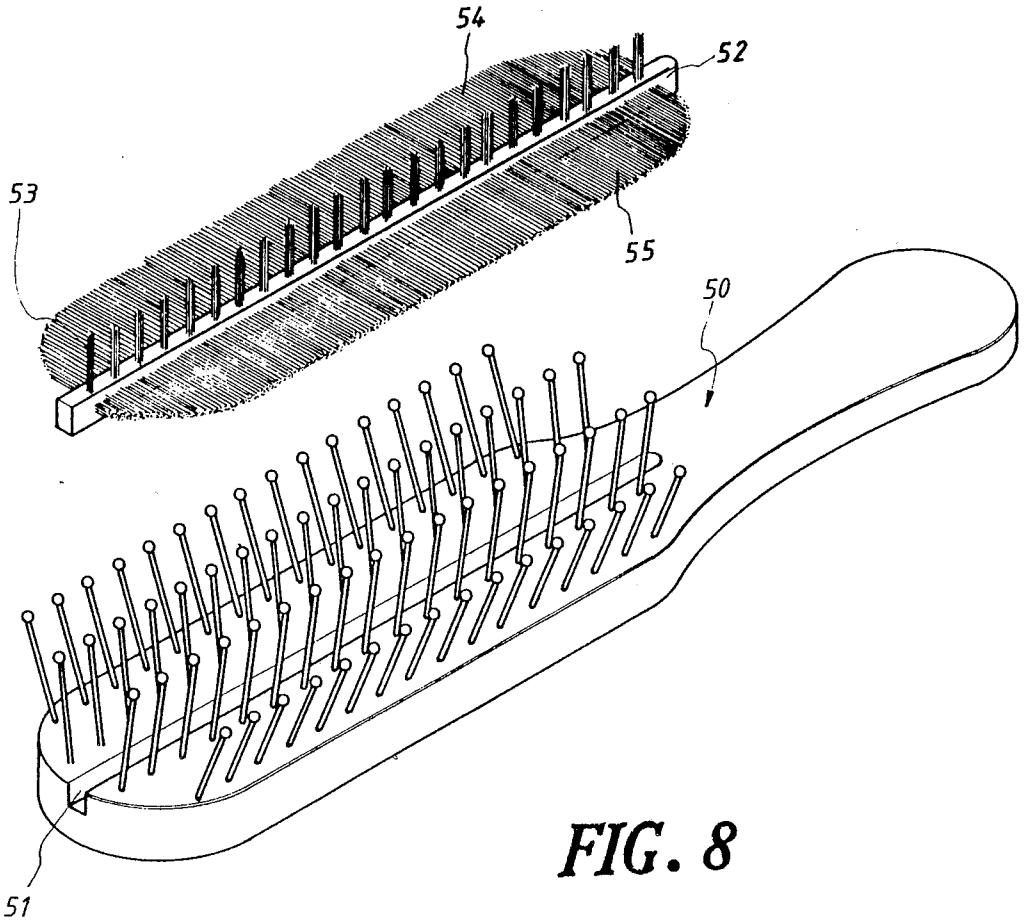
FIG. 8 is an exploded view of a comb in FIG. 7.

As shown in FIGS. 7 and 8, a fourth preferred embodiment of the present comb includes a combing body 50 having a longitudinal middle groove 51 matching therein a straight frame 52 which also implants thereon shorter combing units 53 and provides along two opposite sides thereof soft bristles 54, 55 capable of densely covering the combing portion to form thereon a layer of bristles forming a smooth contact surface in order to make a smooth combing possible.

Figure 9:
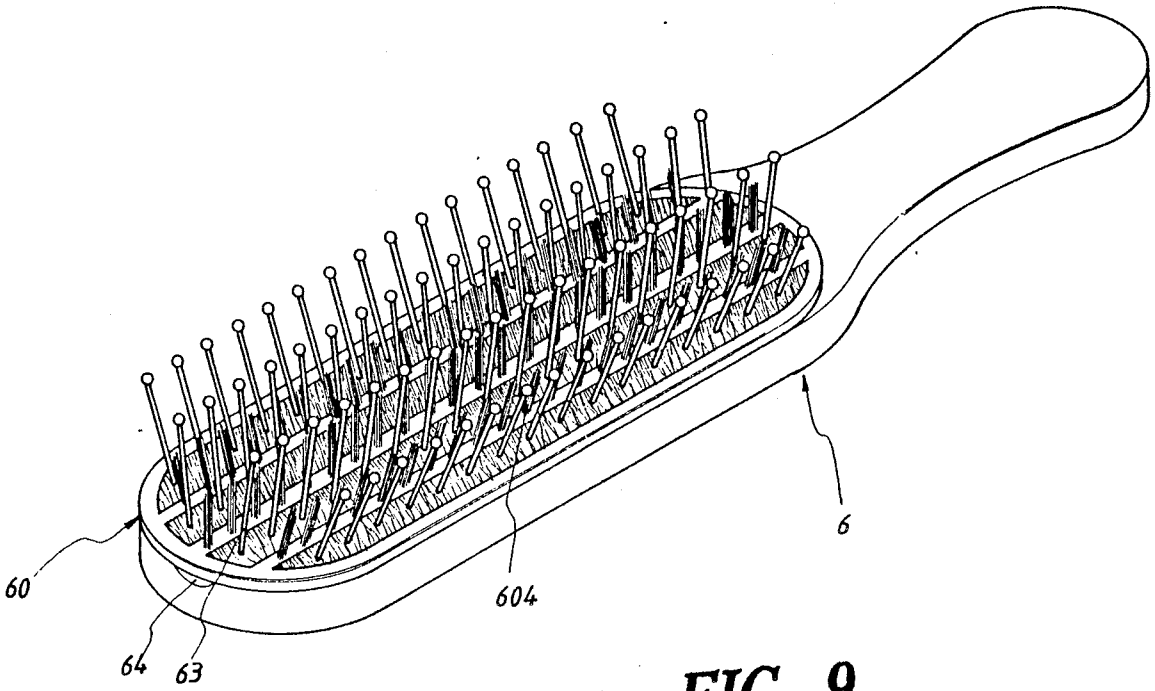
FIG. 9 is a perspective view showing a fifth preferred embodiment of a comb according to the present invention.
Figure 10:
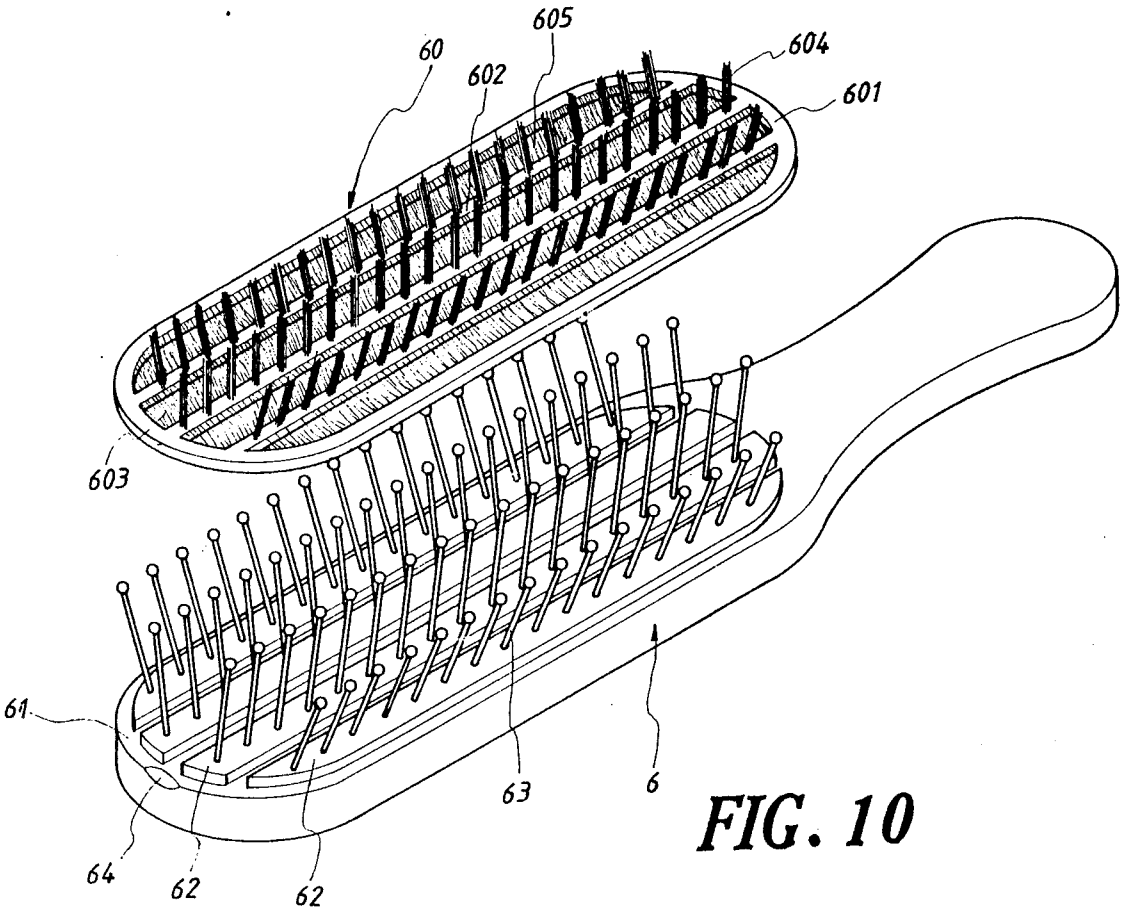
FIG. 10 is an exploded view of a comb in FIG. 9.

As shown in FIGS. 9 and 10, a fifth preferred embodiment of the present comb includes a combing body 6 having combing portion 62 which implants thereon combing units 63 and includes a plurality of longitudinal through grooves respectively matching therein a plurality of straight pieces 602 of a frame 60 which also implants thereon shorter combing units 604, includes an outer frame 601 matched on the outer circumference 61 of combing portion 62, and has longitudinal spaces or grooves thereof 603 that are provided with soft bristles 605 extending from two opposite sides of straight pieces 602 or the inner side of outer frame 601. Combing units 604 will help to comb one's hair more smoothly and hairs 605 form a smooth contact surface of a hairy layer on combing portion 62. Certainly, frame 60 can be provided with, as in the first preferred embodiment, a front indentation 64 and bottom protuberances engaging with top recesses of outer circumference 61.

The layer of bristles formed by the present invention can collect thereon combings and scraps and the frame can be detached from the combing portion for being cleaned or cleaning the combing units and/or the combing portion. In addition, the layer of bristles forms a smooth contact surface on the combing portion so that a smooth combing function can be obtained.

Through the above decription, it should now become readily apparent how and why the present invention can achieve the objects it contemplates.

What I claim is:

1. A comb comprising:

(a) a combing body having a combing portion;

(b) a plurality of combing units forming a plurality of comb groups, each combing unit having a free end and a root end, the root end being mounted in a fixed position relative to the combing body, the root ends of the combing units being located proximate a comb root surface associated with the combing body, the free ends of the combing units extending outwardly from the root surface;

(c) a frame member detachably connected to the combing body and forming a closed loop and a plurality of openings, each opening receiving one of the groups of combing units;

(d) a multiplicity of first bristles fixably connected to the frame member and forming a dense row of the first bristles extending inwardly from opposite sides of the loop of the frame member in a bristle surface, the bristle surface being located proximate the comb root surface with the combing units protruding the bristles surface for facilitating the removal of hair from the combing units upon detachment of the frame member from the combing body and withdrawal of the combing units from the first bristles.

2. The comb of claim 1, wherein the combing units form a plurality of comb rows.

3. The comb of claim 1, wherein as least some of the combing units each comprise a comb tooth.

4. The comb of claim 1, at least some of the combing units each comprise a clump of second bristles.

5. The comb of claim 1, wherein at least some of the first bristles are substantially as soft as natural hairs of a human being.

6. The comb of claim 1, wherein the frame member is formed to include a plurality of bottom protuberances, and the combing body includes a corresponding plurality of cavities for detachably receiving the protuberances.

7. The comb of claim 1, wherein the frame member comprises an outer portion, the outer portion enclosing at least some of the comb groups, and a plurality of straight elongate bar positions, each of the bar portions having a portion of the first bristles extending on opposite sides thereof.

8. The comb of claim 1, wherein the combing units are first combing units, the comb further comprsing a plurality of second combing units fixably connected to the frame member.

9. The comb of claim 8, wherein the second combing units are shorter than the first combing units.

10. The comb of claim 8, wherein at least some of the first combing units each comprise comb teeth and at least some of the second comb units each comprise a clump of second bristles.

11. The comb of claim 1, wherein at least some of the combing units are implanted in the combing body, the bristles forming a covering for preventing a user's hair from becoming caught between the root ends of the combing units and the combing body.

12. A comb comprising:

(a) a combing body having a combing portion;

(b) a plurality of combing units comprising two groups of the combing units, each combing unit having a free end and a root end, the root end being mounted in a fixed position relative to the combing body, the root ends of the combing units being located proximate a comb root surface associated with the combing body, the free ends of the combing units extending outwardly from the comb root surface;

(c) a frame member detachably connected to the combing body, comprising an elongate bar, the bar being demountably connected to the combing body between the groups of combing units;

(d) a multiplicity of bristles fixably connected to the frame member and forming a dense row of the bristles extending outwardly from opposite sides of the bar of the frame member in a bristle surface, the bristle surface being located proximate the comb root surface with the combing units protruding the bristle surface for facilitating the removal of hair from the combing units upon detachment of the frame member from the combing body and withdrawal of the combing units from the bristles.

13. The comb of claim 12, wherein the bar is received in a slot that is formed in the combing body.

14. The comb of claim 12, wherein at least some of the combing units are implanted in the combing body, the bristles forming a covering for preventing a user's hair from becoming caught between the root ends of the combing units and the combing body.

15. A comb comprising:

(a) a combing body having a combing portion;

(b) at least two sets of combing units extending oppositely from opposite sides of the combing body, each combing unit having a free end and a root end, the root end being mounted in a fixed position relative to the combing body, the root ends of the combing units being located proximate a comb root surface associated with the combing body, the free ends of the combing units extending outwardly from the comb root surface;

(c) at least two frame members detachably connected to the combing body;

(d) a multiplicity of first bristles fixably connected to the frame member and forming a dense row of the first bristles extending from the frame member in a bristle surface, the bristle surface being located proximate the comb root surface with the combing units protruding the bristle surface for facilitating the removal of hair from the combing units upon detachment of the frame member from the combing body and withdrawal of the combing units from the first bristles, each of the frame members having a portion of the first bristles in a corresponding portion of the bristle surface, the frame members being demountably connected to the combing body with the combing units of each set protruding the corresponding portion of the associated bristle surface portion.

16. The comb of claim 15, wherein at least some of the combing units are implanted in the combing body, the bristles forming a covering for preventing a user's hair from becoming caught between the root ends of the combing units and the combing body.

17. The comb of claim 15, wherein at least some of the combing units each comprise a clump of second bristles.

* * * * *